US005806549A

United States Patent [19]

Love

[11] Patent Number: 5,806,549

[45] Date of Patent: Sep. 15, 1998

[54] COLLAPSIBLE SHELTER FOR VEHICLE

[75] Inventor: Tracy R. Love, Baltimore, Md.

[73] Assignee: Tracy Love, Balto, Md.

[21] Appl. No.: 773,091

[22] Filed: Dec. 24, 1996

[51] Int. Cl.[6] ..... E04H 15/48

[52] U.S. Cl. ..... 135/143; 135/144; 135/151; 135/119

[58] Field of Search ..... 135/148, 143, 135/151, 900, 901, 902, 128, 114, 115, 116, 120.4, 120.3, 144, 130, 134, 146, 119

[56] References Cited

U.S. PATENT DOCUMENTS

| | | | |
|---|---|---|---|
| 1,520,569 | 12/1924 | Emerson | 135/120.4 X |
| 2,535,618 | 12/1950 | Williams | 135/157 X |
| 3,766,573 | 10/1973 | Burkholz et al. | 135/115 X |
| 4,066,089 | 1/1978 | Rainwater | 135/143 X |
| 4,077,418 | 3/1978 | Cohen | 135/173 X |
| 4,607,656 | 8/1986 | Carter | 135/122 X |
| 4,947,884 | 8/1990 | Lynch . | |
| 5,144,780 | 9/1992 | Gieling et al. | 135/157 X |
| 5,167,246 | 12/1992 | Mortenson | 135/143 X |
| 5,274,980 | 1/1994 | Zeigler . | |
| 5,390,685 | 2/1995 | McCoy . | |
| 5,441,069 | 8/1995 | Meos | 135/115 X |
| 5,487,402 | 1/1996 | Clary | 135/120.4 X |
| 5,560,384 | 10/1996 | Oh | 135/115 |
| 5,671,766 | 9/1997 | Williams | 135/157 X |

FOREIGN PATENT DOCUMENTS

| | | | |
|---|---|---|---|
| 0745004 | 5/1933 | France | 135/143 |
| 0623900 | 5/1949 | United Kingdom | 135/130 |

*Primary Examiner*—Lanna Mai

[57] ABSTRACT

A collapsible shelter comprising frame and canopy, particularly suitable for sheltering a motor vehicle. The frame has a folding or collapsible quadrilateral, perimetric member for supporting a fabric canopy, and four removable, collapsible legs. Separate weighted feet are provided for the legs. The quadrilateral frame has hinged joints enabling folding of the frame. Rigid sleeves are slidably disposed upon the frame members for preventing folding or collapse when covering the hinged joints and enabling folding or collapse when slid away from the hinged joints. Optionally, tethers are provided to anchor the canopy to the motor vehicle. Each tether has a hook at one end, for engaging a hole formed in the canopy, and a suction cup at the other end for attaching to the motor vehicle.

6 Claims, 3 Drawing Sheets

COLLAPSIBLE SHELTER FOR VEHICLE

BACKGROUND OF THE INVENTION

1. Field of the Invention

The present invention relates to tents and canopies, generally, and more particularly to a collapsible canopy having a folding frame and a removable fabric top panel. The novel collapsible canopy is free standing and is supported on the ground after assembly.

2. Description of the Prior Art

Collapsible structures providing a measure of protection against sun, rain, and the like are well known. These structures or shelters typically include a fabric canopy, a frame for supporting the canopy, and legs for supporting the frame above the ground. The principal advantage of collapsible construction is that the shelter is readily portable. However, to be more universally practical, a collapsible shelter should be compact when collapsed, and readily erected.

One significant use for a collapsible shelter is to provide temporary protection when servicing a motor vehicle. While commercial establishments may enjoy the luxury of service buildings, it is very often the case that a private individual has no corresponding sheltered structure for his or her own transport vehicle. It is therefore desirable to provide a collapsible shelter suited for sheltering a person while performing maintenance and repairs to a motor vehicle.

U.S. Pat. No. 5,390,685, issued to Jens McCoy on Feb. 21, 1995, illustrates a collapsible shelter having a single, centrally located leg, in the manner of an umbrella. McCoy's device differs from the present invention in requiring many separable parts to form the frame, and by having the centrally located leg. The centrally located leg would interfere with most tasks being performed on a motor vehicle. By contrast, the frame of the present invention folds rather than disassembling. The many legs of the present invention are capable of straddling the motor vehicle, thereby enabling the canopy to cover and overhang the same.

Four legged canopies are seen in U.S. Pat. Nos. 4,947,884, issued to James P. Lynch on Aug. 14, 1990, and 5,274,980, issued to Theodore R. Zeigler on Jan. 4, 1994. Both of these devices collapse in scissors fashion, this term signifying that there are pivot joints enabling one or more linear members to fold by pivoting at these joints. However, the device of Lynch has a peaked canopy frame, and both legs and canopy frame collapse or fold as a unit. By contrast, the canopy frame of the novel shelter is flat and has only perimetric canopy frame members. In the present invention, only the canopy frame collapses by scissors action. The legs in the novel shelter are removed from the canopy frame.

Zeigler's shelter is quite complicated, compared to the present invention and has a bowed, or curved peaked canopy frame. Canopy tension is maintained by cables. When collapsing, upper members of Zeigler's two part legs remain with the canopy frame. By contrast, the present invention has a flat canopy and only perimetric canopy frame members. The legs of the present invention are entirely removed from the canopy frame.

None of the above inventions and patents, taken either singly or in combination, is seen to describe the instant invention as claimed.

SUMMARY OF THE INVENTION

The present invention is highly practical for the purpose of providing a temporary shelter accommodating a motor vehicle. The shelter is large enough to straddle a typical passenger motor vehicle, yet collapses into a volume small enough to fit into a duffle bag. The structure is uncomplicated, so that assembly and disassembly are easily mastered by users. The canopy frame is rectangular, and disposed at the perimeter of the canopy.

The perimetric canopy frame has four members forming the rectangle, each member folding in half at a pivot joint. Sliding sleeves are selectively slid over the joint, to prevent inadvertent folding and collapse, or expose the joint for disassembly and stowage. Because these sleeves are permanently mounted on and entrapped by the canopy frame, they cannot be lost, as inevitably occurs when small components and fasteners are provided in collapsible devices.

The canopy comprises a suitable fabric panel which is stitched or sewn to include a horizontal main panel and four short depending walls. The canopy is lowered over the canopy frame, and is dimensioned and configured to fit sufficiently closely to the erected frame so as not to readily unseat or disengage therefrom. The depending walls may be folded flat with the main panel to allow folding of the canopy along with the frame.

Optionally, tethers may be utilized to anchor the canopy to the vehicle being sheltered. The tethers engage the canopy by hook and the vehicle by suction cup.

The legs supporting the canopy frame above the ground engage the canopy frame in any suitable way. The legs comprise upper and lower sections which are either separable or telescopic and inseparable. Separate, weighted feet are provided for securing the legs at the ground. These feet preclude necessity of penetrating the ground, as by a stake. This feature is desirable when working on a paved or surface of limited penetrability, such as baked soil or gravel. It would be possible to erect the novel shelter without utilizing the weighted feet. However, these feet stabilize the lower ends of the legs, and will frequently expedite assembly and precise positioning of the legs on the ground.

The novel shelter is thus expeditiously assembled without tools. It is sufficiently uncomplicated that its assembly is readily grasped, and that its construction entails minimal bulk, weight, complexity, and cost. No small separate parts which are readily lost are required.

Accordingly, it is a principal object of the invention to provide a shelter which straddles and protects a motor vehicle and can be collapsed to fit into a duffle bag.

It is another object of the invention to avoid complicated construction and to minimize the number of separable components.

It is a further object of the invention to enable manual assembly of the collapsible shelter.

Still another object of the invention is to provide apparatus for selectively preventing folding or collapse of the canopy frame and for enabling such folding or collapse.

An additional object of the invention is to provide a perimetric canopy frame, for minimizing the number of members utilized to form the canopy frame.

It is again an object of the invention to provide tethers for securing the canopy to a motor vehicle being protected by the novel shelter.

Yet another object of the invention is to provide weighted feet for stabilizing ends of the legs of the shelter on impenetrable ground.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
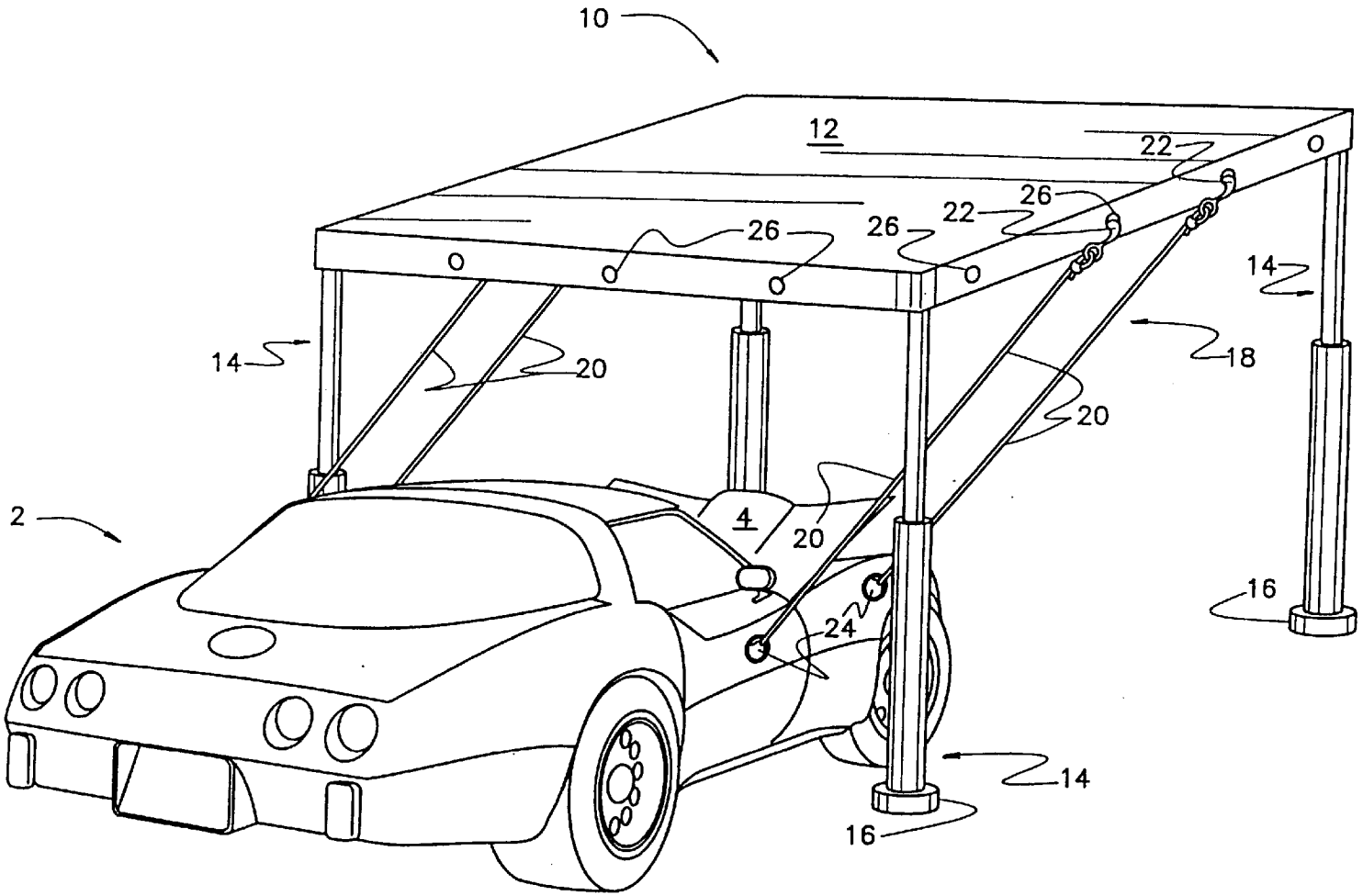
FIG. 1 is an environmental, perspective view of the invention erected over an automobile.

As seen in FIG. 1 of the drawings, novel collapsible shelter 10 is shown erected over and partially covering an automobile 2. Canopy 12 of shelter 10 is supported by legs 14 at a height above the ground to enable hood 4 to be fully open. Legs 14 straddle automobile 2, and are anchored at the ground by feet 16, so that penetration of the ground is not required.

Canopy 12 is also secured to automobile 2 by tethers 18. Each tether 18 has a flexible main section 20 formed by any suitable cord or rope. Each tether 18 has a hook 22 attached at one end, and a suction cup 24 attached at the other end. Hooks 22 engage holes 26 formed in canopy 12 periodically thereabout. Each suction cup 24 is secured against a smooth surface of the automobile 2, such as body panels and windows.

Figure 2:
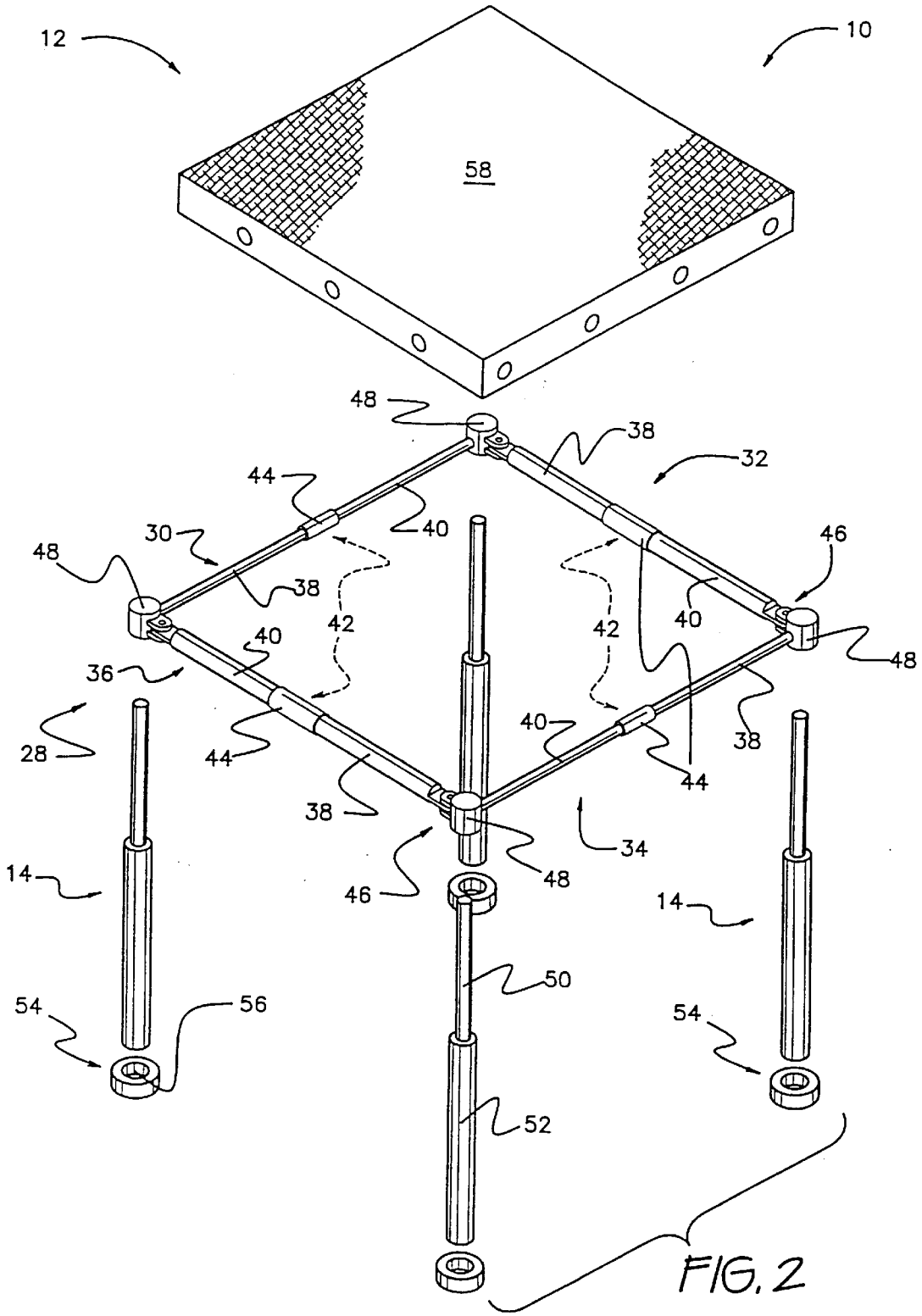
FIG. 2 is an exploded perspective view of the invention.

FIG. 2 shows how canopy 12 is supported. Shelter 10 has a collapsible canopy frame 28. In a preferred embodiment, frame 28 and canopy 12 are quadrilateral, with one leg 14 depending from frame 28 at each corner. Of course, other geometric shapes could be utilized if desired. However, it is contemplated that a quadrilateral configuration is optimal since this configuration is similar to many motor vehicles, driveways, and buildings.

Also, this configuration allows for four legs 14 to be located at the outermost extremities of the quadrilateral figure. Four legs 14 provide a reasonable degree of stability. More legs would increase stability, but at a penalty in complexity, cost, and intrusion upon useful space.

Frame 28 includes four adjacent linear, rigid frame members 30, 32, 34, 36. Each frame member 30, 32, 34, or 36 comprises two sections 38, 40 and a pivot joint 42 pivotally or foldably joining sections 38 and 40. Therefore, each frame member 30, 32, 34, or 36 can fold or collapse if not restrained.

When rigidity is required for properly supporting canopy 12, restraint is provided by locking apparatus preventing a frame member 30, 32, 34, or 36 from folding at its associated pivot joint 42. This is accomplished by sleeves 44. Sleeves 44 slidably encircle a section 38 or 40 of each frame member 30, 32, 34, or 36. Each sleeve 44 slides between a locking position covering its associated pivot joint 42 and overlaps both sections 38, 40 of each frame member 30, 32, 34, or 36. This action constrains the two sections 38, 40 against angular axial motion relative to the other, and an unlocked position removing constraint preventing angular axial motion. It will be appreciated that this arrangement avoids use of removable small parts and fasteners, and is readily operated by hand.

In addition to pivot joints 42, each frame member 30, 32, 34, and 36 has a hinge 46 providing pivotal connection to each adjacent frame member 30, 32, 34, or 36. Thus, canopy frame 28 has individually collapsible members extending only along its perimeter, canopy 12 being supported at the perimeter. This construction avoids unnecessary complication and also allows collapse or folding of canopy frame 28 as will be described hereinafter.

Frame members 30 and 34 each terminates in two receptacles 48 for receiving the upper end of a leg 14. Receptacle 48 may include a bore (not shown) for snugly receiving leg 14. Alternatively, receptacle 48 may include structure such as threading or groove for receiving a dog (not shown) or the like projecting from leg 14, where a more secure interfit engagement is desired.

Legs 14 each comprise an upper section 50 and a lower section 52. Provision is made for collapsing leg 14. This may be accomplished by causing leg sections 50 and 52 to be separable, and joined by frictional fit or in a manner described with regard to connection of leg 14 to a receptacle 48. Alternatively, sections 50 and 52 may be telescopic in nature. Whichever embodiment is selected, each leg 14 may be reduced in length for stowage when shelter 10 is dismantled.

Each leg 14 is preferably provided with a weighted foot 54. Foot 54 may comprise a ring of heavy material, such as iron or steel, or any other suitable material. The precise weight should exceed that of the entire leg 14, so that leg 14 cannot move about readily on the ground. Feet 54 enable legs 14 to be stably located on impenetrable ground, such as a paved surface, hard packed soil, rock, and gravel. Each foot has an opening 56 for receiving the lower end of leg 14, or any other suitable structure for removably attaching to its associated said leg 14.

Canopy 12 comprises a main panel 58 which is horizontal when shelter 10 has been erected on horizontal ground. Short walls 60 depend from panel 58 at the perimeter of panel 58. These walls are preferably continuous and sewn or stitched to main panel 58 so as to form a skirt. Canopy 12 is dimensioned and configured so that it fits closely enough onto canopy frame 28 to avoid being readily dislodged by wind, but sufficiently loosely to be readily installed on and removed from canopy frame 28. Alternately, the short walls 60 may be folded up onto the top of the main panel allowing the fabrick canopy to be folded along with the canopy frame as described later. Holes 26 are preferably disposed upon each short wall 60 to provide versatility in anchoring canopy 12 to automobile 2. However, it would be possible to locate holes 26 within two opposing short walls 60, since it is not necessary to accommodate every possible orientation of shelter 10 to automobile 2.

Figure 3:
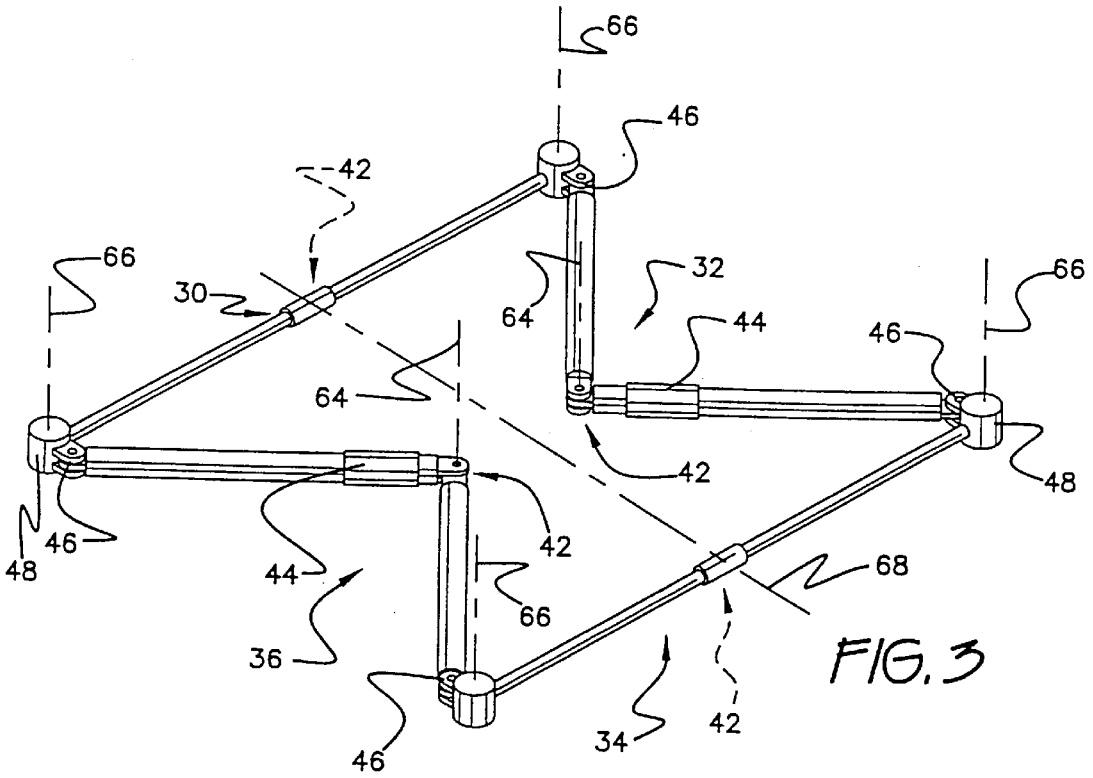
FIG. 3 is a top perspective detail view of the canopy frame, illustrating a first intermediate configuration when folding or collapsing the canopy frame.

Turning now to FIG. 3, folding or collapsing of shelter 10 is described. Canopy 12 and legs 14 are manually removed from canopy frame 28. Legs 14 may be collapsed or dismantled for stowage, as is appropriate. Canopy frame 28 is folded by first sliding sleeves 44 out of the locking position into the unlocked position, as is illustrated regarding frame members 32 and 36. Sleeves 44 of frame members 30 and 34 remain in the locked position. Frame members 32 and 36 are then collapsed by folding them at their respective pivot joints 42.

Figure 4:
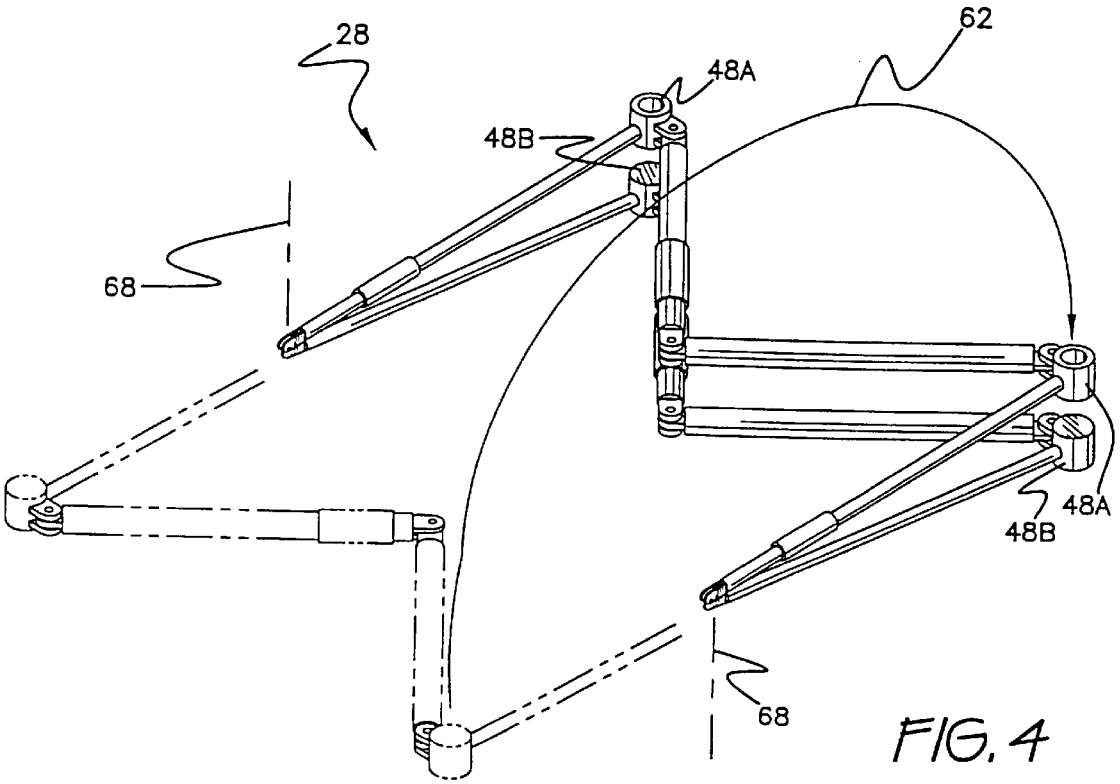
FIG. 4 is a top perspective detail view of the canopy frame, illustrating a final configuration when folding or collapsing the canopy frame.

The next step of folding or collapsing canopy frame 28 is shown in FIG. 4. As indicated by arrow 62, the left side of canopy frame 28 is swung around until receptacles 48A of the left side of canopy frame 28 approach receptacles 48B of the right side of canopy frame 28. For this folding or collapsing scheme to succeed, it is necessary that the axes 64 (see FIG. 3) of rotation of pivot joints 42 of frame members 32 and 36 and axes 66 (see FIG. 3) of rotation of hinges 46 be vertical. Axes 68 of pivot joints 42 of frame members 30 and 34 are horizontal. Of course, a similar folding scheme will ensue should horizontal and vertical orientations of these axes be reversed.

The members of canopy frame 28 and upper and lower sections 52 of legs 14 are preferably such that their overall lengths after collapsing are about equal. This enables shelter 10 to be stored in a duffle bag (not shown) or similar unobtrusive container after collapsing and dismantling. Shelter 10 may thus be stowed in the motor vehicle it serves without unduly occupying space or projecting into space devoted to storage or passengers.

It is to be understood that the present invention is not limited to the embodiments described above, but encompasses any and all embodiments within the scope of the following claims.

I claim:

1. A collapsible shelter comprising:

a perimetric canopy frame having a perimeter and a plurality of rigid, linear frame members disposed only along said perimeter of said canopy frame, each said frame member having hinge means for pivotal connection to each adjacent said frame member;

a canopy having means for attaching to said canopy frame, said canopy having a horizontal main panel, a perimeter, and short walls depending from said main panel at said perimeter; said canopy further having holes periodically disposed within at least two of said short walls of said canopy;

a plurality of legs each having means for attaching to said canopy frame; and a plurality of tethers each comprising a flexible main section having two ends, there being a hook disposed at one of said ends and a suction cup disposed at the other of said ends, whereby said canopy is adapted to anchor to a motor vehicle disposed therebeneath.

2. The collapsible shelter according to claim 1, said canopy frame members each comprising two sections and a pivot joint pivotally or foldably joining said two sections, and locking means for preventing each said pivot joint from pivoting or folding.

3. The collapsible shelter according to claim 2, said locking means comprising a sleeve slidably disposed upon each said canopy frame member and slidable to a locking position covering said pivot joint and overlapping both of said two sections of each said canopy frame member, thereby constraining each said canopy frame member against angular axial motion relative to the other said canopy frame member, and to an unlocked position removing constraint preventing said angular axial motion.

4. The collapsible shelter according to claim 1, each said leg having leg collapsing means, whereby each said leg may be reduced in length for stowage.

5. The collapsible shelter according to claim 1, further comprising weighted feet, there being one said weighted foot for each said leg, each said weighted foot having means for removably attaching to its associated said leg.

6. A collapsible shelter comprising:

a perimetric canopy frame having a perimeter and a plurality of rigid, linear frame members disposed only along said perimeter of said canopy frame, each said frame member having hinge means for pivotal connection to each adjacent said frame member, and comprising two sections, a pivot joint pivotally joining said two sections, and locking means for preventing each said pivot joint from pivoting; said pivot joint comprising a sleeve slidably disposed upon each of said canopy frame member and slidable to a locking position covering said pivot joint and overlapping both of said two sections of each canopy frame member, thereby constraining each canopy frame member against angular axial motion relative to the other canopy frame member, and to an unlocked position removing constraint that prevents said angular axial motion;

a canopy having a horizontal main panel, a perimeter, short walls depending from said main panel at said perimeter, and means for removably attaching to said canopy frame; said canopy having holes periodically disposed within at least two of said short walls;

a plurality of tethers each comprising a flexible main section having two ends, there being a hook disposed at one end and a suction cup disposed at the other end, whereby said canopy is adapted to anchor to a motor vehicle disposed therebeneath;

a plurality of legs each having means for attaching to said canopy frame, each leg having leg collapsing means to reduce its length for stowage; and a plurality of weighted feet, each weighted foot having means for removably attaching to an associated leg.

* * * * *